US010082325B2

(12) United States Patent
Saito et al.

(10) Patent No.: US 10,082,325 B2
(45) Date of Patent: Sep. 25, 2018

(54) REFRIGERATING APPARATUS

(71) Applicant: Mitsubishi Electric Corporation, Tokyo (JP)

(72) Inventors: Makoto Saito, Tokyo (JP); Fumitake Unezaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 208 days.

(21) Appl. No.: 14/908,686

(22) PCT Filed: Sep. 10, 2013

(86) PCT No.: PCT/JP2013/074403

§ 371 (c)(1),
(2) Date: Jan. 29, 2016

(87) PCT Pub. No.: WO2015/037057

PCT Pub. Date: Mar. 19, 2015

(65) Prior Publication Data

US 2016/0161162 A1 Jun. 9, 2016

(51) Int. Cl.

| | |
|---|---|
| ***F25B 47/00*** | (2006.01) |
| ***F25B 47/02*** | (2006.01) |
| *F28D 20/00* | (2006.01) |

(52) U.S. Cl.

CPC ..... *F25B 47/022* (2013.01); *F25B 2400/13* (2013.01); *F25B 2400/24* (2013.01); *F28D 20/00* (2013.01)

(58) Field of Classification Search

CPC .... F25B 47/022; F25B 2400/13; F25B 47/02; F28D 20/00

See application file for complete search history.

(56) References Cited

U.S. PATENT DOCUMENTS

2009/0314023 A1* 12/2009 Labaste Mauhe ..... B60H 1/005 62/335
2011/0197600 A1* 8/2011 Hamada ..... F24H 4/04 62/79
2013/0042640 A1* 2/2013 Higashiiue ..... F25B 41/00 62/196.1

FOREIGN PATENT DOCUMENTS

CN 101338960 A 1/2009
JP 1985-096550 U 7/1985

(Continued)

OTHER PUBLICATIONS

Translation of CN 101338960A.*

(Continued)

*Primary Examiner* — Elizabeth Martin
(74) *Attorney, Agent, or Firm* — Posz Law Group, PLC

(57) ABSTRACT

A refrigerating apparatus includes: a refrigerating circuit in which a refrigerant that is discharged from a compressor is conveyed under pressure sequentially to a first flow rate controlling apparatus, a heat storing tank, a condenser, a first decompressing apparatus, and an evaporator, and is recycled to the compressor; a defrosting circuit in which the refrigerant that is discharged from the compressor is conveyed under pressure sequentially to the first flow rate controlling apparatus, the heat storing tank, the first decompressing apparatus, and the evaporator, and is recycled to the compressor; and a flow channel switching apparatus that connects an outlet side of the heat storing tank to an inlet side of the condenser or to an inlet side of the first decompressing apparatus to form the refrigerating circuit or the defrosting circuit.

7 Claims, 4 Drawing Sheets

(56) References Cited

FOREIGN PATENT DOCUMENTS

| | | | |
|---|---|---|---|
| JP | 04-292761 | A | 10/1992 |
| JP | 05-001966 | U | 1/1993 |
| JP | 11-294906 | A | 10/1999 |
| JP | 2008-082589 | A | 4/2008 |
| JP | 2011-112264 | A | 6/2011 |
| JP | 2013-104586 | A | 5/2013 |
| WO | 2010/041453 | A1 | 4/2010 |
| WO | WO2011122085 | A1 * | 10/2011 |

OTHER PUBLICATIONS

Translation of W02011122085A1.*
Office Action dated Dec. 14, 2016 issued in corresponding CN patent application No. 201380079484.7 (and English translation).
Extended European Search Report dated May 2, 2017 in the corresponding EP application No. 13893298.3.
International Search Report of the International Searching Authority dated Dec. 3, 2013 for the corresponding international application No. PCT/JP2013/074403 (and English translation).

* cited by examiner

REFRIGERATING APPARATUS

CROSS REFERENCE TO RELATED APPLICATION

This application is a U.S. national stage application of PCT/JP2013/074403 filed on Sep. 10, 2013, the contents of which are incorporated herein by reference.

TECHNICAL FIELD

The present invention relates to a refrigerating apparatus that cools and maintains an internal portion of a cold storage room, for example, at a set temperature, and particularly relates to a refrigerating apparatus that performs defrosting operation using hot gas.

BACKGROUND

In refrigerating apparatuses of this kind, because frost builds up in evaporators and obstructs heat transfer during cooling operation, defrosting operations are performed periodically. Known defrosting operations include: methods in which electric current is passed through an electric heater that is embedded in the evaporator; and methods in which high-temperature refrigerant that has just been discharged from the compressor is allowed to flow directly into frosted cooling air (hot gas bypass methods).

However, because the temperature inside the cold storage room rises during defrosting operations in which cooling capacity is not fully operational, it is desirable to complete defrosting in as short a time as possible.

Furthermore, if defrosting is performed by allowing high-temperature refrigerant that is discharged from the compressor to flow through to the evaporator, then the refrigerant is still at high pressure and in liquid form. This liquefied high-pressure refrigerant is decompressed at a pressure regulating valve, for example, and is vaporized by exchanging heat with a heat storing agent in a low-pressure heat exchange path before being sucked into the compressor. However, the refrigerant may not be completely vaporized, and there has been a risk that a portion may be sucked into the compressor while remaining in liquid form and damage the compressor.

In consideration of such conditions, conventional refrigerating apparatuses have been proposed that include: a refrigerant circuit that conveys refrigerant that has been discharged from the compressor under pressure sequentially to a condenser, a decompressing apparatus, and an evaporator, and is recycled to the compressor; and a defrosting circuit that performs defrosting of the evaporator by conveying refrigerant that has been discharged from the compressor under pressure directly to the evaporator, wherein a heat storing apparatus is disposed that places a pipeline between the compressor and the condenser in the refrigerating circuit and a pipeline between the compressor and the evaporator in the defrosting circuit in contact thermally by means of a heat storing agent, defrosting time being shortened by storing heat from the discharged refrigerant from the compressor in the heat storing apparatus while the refrigerating circuit is operating, and using the heat that has been stored in the heat storing apparatus while the defrosting circuit is operating (see Patent Literature 1, for example).

Refrigerating apparatuses have also been proposed that include: a compressor; a condenser; a throttling apparatus; an evaporator; and a heat storing tank that incorporates a lower-pressure heat exchange path, a higher-pressure heat exchange path, and a heat storing agent, wherein the lower-pressure heat exchange path is connected to the refrigerating circuit as a parallel circuit by a suction bypass pipe, and a suction accumulator is disposed on the suction bypass pipe downstream from the lower-pressure heat exchange path, and liquid refrigerant that has not vaporized completely within the lower-pressure heat exchange path is accumulated in the suction accumulator such that only gaseous refrigerant is allowed to be sucked into the compressor when performing defrosting (see Patent Literature 2, for example).

Patent Literature 1: Japanese Patent Laid-Open No. HEI 4-292761 (Gazette)

Patent Literature 2: Japanese Utility Model Laid-Open No. HEI 5-1966 (Gazette)

In conventional refrigerating apparatuses such as that described in Patent Literature 1, some problems have been that two heat exchanging portions, i.e., a heat exchanging portion for storing heat during cooling operation, and a heat exchanging portion for using the stored heat during defrosting operation, are required, increasing equipment costs, and that dedicated piping is also required to absorb stored heat into the hot gaseous refrigerant and convey it to the evaporator during defrosting operation, increasing construction costs. Furthermore, in conventional refrigerating apparatuses such as that described in Patent Literature 1, no consideration has been given to vaporizing the liquid refrigerant that remains in the refrigerant after defrosting.

In conventional refrigerating apparatuses such as that described in Patent Literature 2, because two heat exchanging portions are required, i.e., a heat exchanging portion for storing heat during cooling operation, and a heat exchanging portion for using the stored heat during defrosting operation and vaporizing the liquid refrigerant that remains in the refrigerant after defrosting, and a large-diameter on-off valve for switching the flow channel on the lower-pressure side is also required, one problem has been that equipment costs are increased.

SUMMARY

The present invention aims to solve the above problems and an object of the present invention is to provide a refrigerating apparatus that can prevent recycling of liquid refrigerant to a compressor, and that can shorten defrosting time, without increasing construction costs and equipment costs.

A refrigerating apparatus according to the present invention includes: a refrigerating circuit in which a refrigerant that is discharged from a compressor is conveyed under pressure sequentially to a first flow rate controlling apparatus, a heat storing tank, a condenser, a first decompressing apparatus, and an evaporator and, is recycled to the compressor; a defrosting circuit in which the refrigerant that is discharged from the compressor is conveyed under pressure sequentially to the first flow rate controlling apparatus, the heat storing tank, the first decompressing apparatus, and the evaporator, and is recycled to the compressor; and a flow channel switching apparatus that selectively connects an outlet side of the heat storing tank to an inlet side of the condenser or to an inlet side of the first decompressing apparatus to form the refrigerating circuit or the defrosting circuit.

According to the present invention, in the refrigerating circuit, evaporation waste heat from the refrigerant that is discharged from the compressor is stored in the heat storing tank. Then, in the defrosting circuit, the refrigerant that is discharged from the compressor, while flowing through the heat storing tank, absorbs the evaporation waste heat from the refrigerant that is stored in the heat storing tank, enabling the amount of defrosting heat to be increased, and shortening defrosting time.

Because the heat storing tank that stores the evaporation waste heat from the refrigerant in the refrigerating circuit also functions as a heat storing tank that allows the refrigerant in the defrosting circuit to absorb the evaporation waste heat, equipment costs are reduced.

In the defrosting circuit, high-pressure gaseous refrigerant that is discharged from the compressor is decompressed by the first flow rate controlling apparatus, becomes a low-temperature, low-pressure gaseous refrigerant, and flows to the heat storing tank. The refrigerant that flows into the heat storing tank, absorbs evaporation waste heat that is stored in the heat storing tank, becoming high-temperature, low-pressure gaseous refrigerant, and flows to the evaporator. Thus, because the refrigerant enters a superheated gaseous state without condensing to a liquid, and flows out of the evaporator, recycling of liquid refrigerant to the compressor is prevented.

DETAILED DESCRIPTION

Embodiment 1

Figure 1:
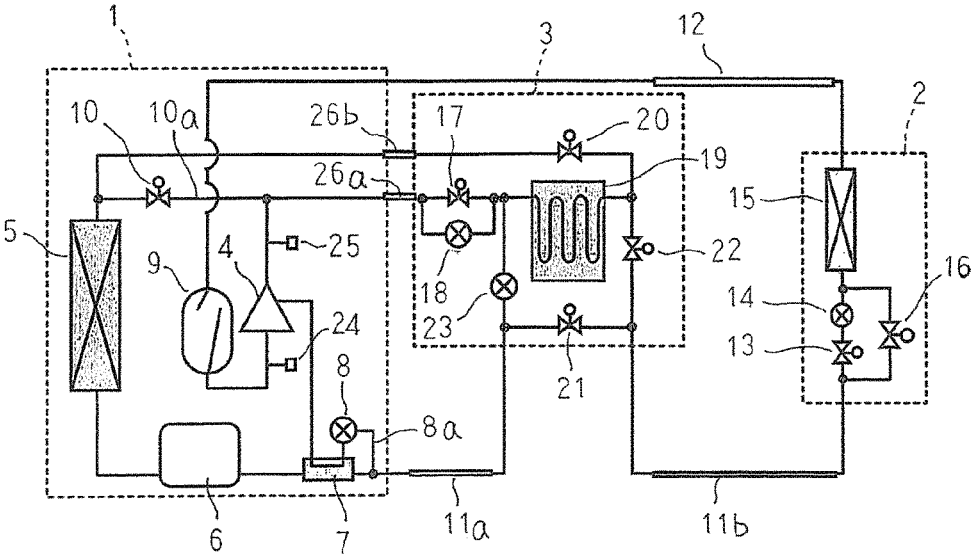
FIG. 1 is a refrigerant circuit configuration diagram for a refrigerating apparatus according to Embodiment 1 of the present invention.

FIG. 1 is a refrigerant circuit configuration diagram for a refrigerating apparatus according to Embodiment 1 of the present invention.

In FIG. 1, a refrigerating apparatus includes: a heating unit 1 that is installed outside; a refrigerating unit 2 that is installed inside a freezing chamber that is subject to cooling; and a defrosting unit 3. The heating unit 1 and the defrosting unit 3 are connected by means of first and second discharge gas connection piping 26*a* and 26*b* and first high-pressure piping 1 la. The refrigerating unit 2 is connected to the defrosting unit 3 by means of second high-pressure piping 11*b*, and is connected to the heating unit 1 by means of low-pressure piping 12. Moreover, in Embodiment 1, the number of refrigerating units 2 is one unit, but the number of units may be two or more units.

The heating unit 1 includes: a compressor 4 that compresses a refrigerant; an air-cooled condenser 5; a receiver 6; an economizer 7 that functions as a first heat exchanging portion; an economizer expansion valve 8 that functions as a second flow rate controlling apparatus; and an accumulator 9. A discharge side of the compressor 4 is connected to first discharge gas connection piping 26*a*, and is also connected to an inlet of the air-cooled condenser 5 by means of second bypass piping 10*a*. A discharge bypass valve 10 is disposed in the second bypass piping 10*a*.

The second discharge gas connection piping 26*b* is connected to the inlet of the air-cooled condenser 5. An outlet side of the air-cooled condenser 5 is connected to the first high-pressure piping 11*a* through the receiver 6 and the economizer 7. First bypass piping 8*a* branches off between the economizer 7 and the first high-pressure piping 11*a*, and is connected to intermediate pressure of the compressor 4. The economizer 7 is configured such that refrigerant that flows through the first bypass piping 8*a* exchanges heat with liquid refrigerant that flows in from the receiver 6. The economizer expansion valve 8 is disposed in the first bypass piping 8*a* upstream from the economizer 7. Pressure sensors 24 and 25 are disposed on an intake side and a discharge side of the compressor 4. The low-pressure piping 12 is connected to the intake side of the compressor 4 through the accumulator 9.

The refrigerating unit 2 includes a refrigerant circuit in which high-pressure liquid refrigerant that flows in through the second high-pressure piping 1 lb flows sequentially through a liquid electromagnetic valve 13, a main expansion valve 14, and an evaporator 15. The refrigerating unit 2 also includes a large electromagnetic valve 16 so that high-pressure liquid refrigerant that flows in through the second high-pressure piping 11*b* can bypass the liquid electromagnetic valve 13 and the main expansion valve 14 and flow directly to the evaporator 15 without decompressing. An outlet side of the evaporator 15 is connected to the low-pressure piping 12. Moreover, the liquid electromagnetic valve 13, the main expansion valve 14, and the electromagnetic valve 16 constitute a first decompressing apparatus, the liquid electromagnetic valve 13 and the main expansion valve 14 constitute a first valve apparatus, and the electromagnetic valve 16 constitutes a second valve apparatus.

The defrosting unit 3 includes a refrigerant circuit in which high-temperature refrigerant that flows in through the first discharge gas connection piping 26*a* flows through to the heat storing tank 19 via the electromagnetic valve 17. A hot gas pressure regulating valve 18 is disposed in parallel to the electromagnetic valve 17. An outlet side of the heat storing tank 19 is connected to the second discharge gas connection piping 26*b* by means of an electromagnetic valve 20, and is also connected to the second high-pressure piping 11*b* by means of an electromagnetic valve 22. The first high-pressure piping 11*a* is connected to an inlet side of the heat storing tank 19 by means of a liquid injection valve 23, and is also connected to the second high-pressure piping 11*b* by means of an electromagnetic valve 21. Moreover, the electromagnetic valve 17 and the hot gas pressure regulating valve 18 constitute a first flow rate controlling apparatus. The electromagnetic valves 20 and 22 constitute a flow channel switching apparatus.

In this refrigerating apparatus, difluoromethane (R-32) is sealed inside as a refrigerant. Because the discharge temperature increase of R-32 in the compression process is large, it has advantages such as temperature drops being large once discharged gaseous refrigerant is decompressed, and the amount of heat recovered from the heat storing tank 19 being increased. In addition, R-32 also has advantages such as having very little impact on global warming.

Figure 2:
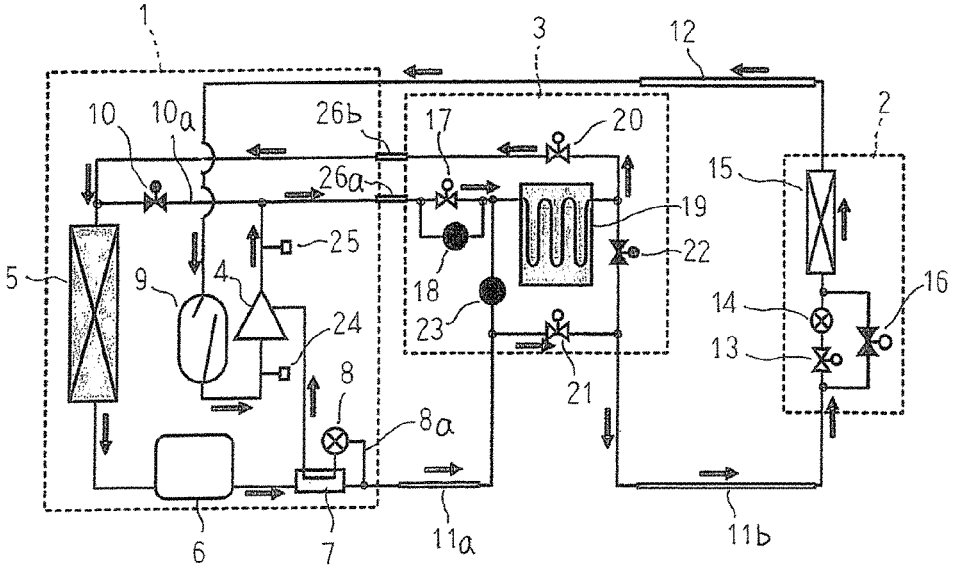
FIG. 2 is a refrigerant circuit diagram that shows flow of refrigerant during cooling operation in the refrigerating apparatus according to Embodiment 1of the present invention.
Figure 3:
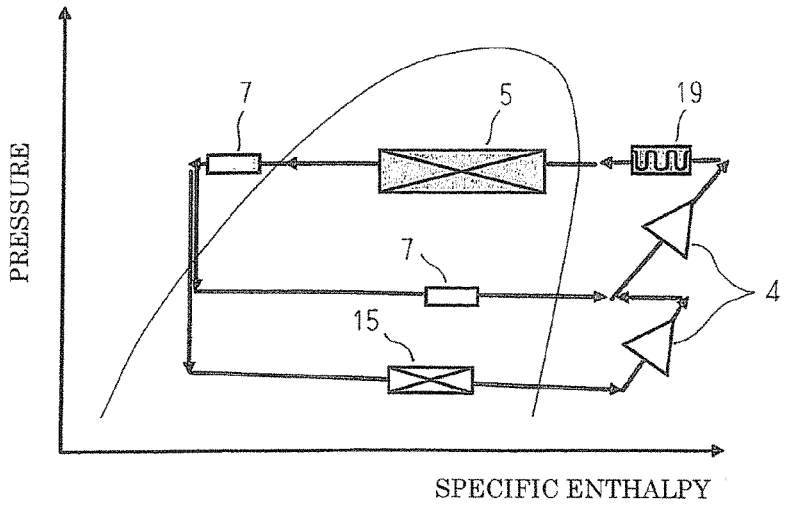
FIG. 3 is a phase diagram that represents refrigeration cycle operations during cooling operation in the refrigerating apparatus according to Embodiment 1 of the present invention.

Next, refrigerating apparatus operations during cooling operation will be explained with reference to FIGS. 2 and 3. FIG. 2 is a refrigerant circuit diagram that shows flow of refrigerant during cooling operation in the refrigerating apparatus according to Embodiment 1 of the present invention, and FIG. 3 is a phase circuit diagram that represents refrigeration cycle operations during cooling operation in the refrigerating apparatus according to Embodiment 1 of the present invention. Moreover, the arrows in FIG. 2 represent refrigerant flow.

In a cooling operation mode, the discharge bypass valve 10, the electromagnetic valves 16 and 22, and the liquid injection valve 23 are closed, and the electromagnetic valves 17, 20, and 21 are opened. A refrigerating circuit is thereby formed in which refrigerant that is discharged from the compressor 4 is conveyed under pressure sequentially to the electromagnetic valve 17, the heat storing tank 19, the electromagnetic valve 20, the air-cooled condenser 5, the liquid electromagnetic valve 13, the main expansion valve 14, and the evaporator 15, and is recycled to the compressor 4.

Then, high-temperature refrigerant that is discharged from the compressor 4 is led to the defrosting unit 3 via the first discharge gas connection piping 26*a*, and flows into the heat storing tank 19. The high-temperature refrigerant exchanges heat with a heat storing medium that is sealed inside the heat storing tank 19 in the process of flowing through the heat storing tank 19. Thus, the heat storing medium becomes hot, accumulating heat from the high-temperature refrigerant.

After exchanging heat with the heat storing medium and becoming slightly lower in temperature, the high-temperature refrigerant is led to the heating unit 1 via the second discharge gas connection piping 26*b*, and flows into the air-cooled condenser 5. The high-temperature refrigerant exchanges heat with external air at the air-cooled condenser 5 to form liquid refrigerant. This liquid refrigerant flows into the economizer 7 via the receiver 6. A portion of the liquid refrigerant that has flowed out of the economizer 7 flows through the first bypass piping 8*a*, and is injected into the intermediate pressure of the compressor 4. The intermediate-pressure refrigerant that branches off from the liquid refrigerant that has flowed out of the economizer 7 exchanges heat with the liquid refrigerant that flows through the economizer 7, increasing specific enthalpy, and is injected into the intermediate pressure of the compressor 4. Abnormal rises in the temperature of the refrigerant that is discharged from the compressor 4 are avoided thereby. Here, the economizer expansion valve 8 adjusts the amount of through flow of the refrigerant that is discharged from the compressor 4 such that the temperature of thereof is within a set range.

The liquid refrigerant that flows through the economizer 7 exchanges heat with the intermediate-pressure refrigerant that flows through the first bypass piping 8*a*, further reducing its temperature, and is led to the refrigerating unit 2 through the first high-pressure piping 11*a*, the electromagnetic valve 21, and the second high-pressure piping 11*b*. The liquid refrigerant that has been led to the refrigerating unit 2 is decompressed by the main expansion valve 14 and flows into the evaporator 15, vaporizes while cooling the air inside the cold storage room, and becomes low-pressure gaseous refrigerant. This low-pressure gaseous refrigerant is led to the heating unit 1 via the low-pressure piping 12. The low-pressure gaseous refrigerant that has been led to the heating unit 1 flows into the accumulator 9, and liquid refrigerant that was not vaporized properly inside the evaporator 15 is accumulated in the accumulator 9. Thus, only gaseous refrigerant is sucked into the compressor 4.

In this cooling operation mode, high-temperature refrigerant that is discharged from the compressor 4 flows into the heat storing tank 19 via the first discharge gas connection piping 26*a*, and evaporation waste heat therefrom is stored in the heat storing medium inside the heat storing tank 19. The heat storing medium inside the heat storing tank 19 thereby becomes sufficiently hot, at approximately 80 degrees Celsius, for example.

Figure 4:
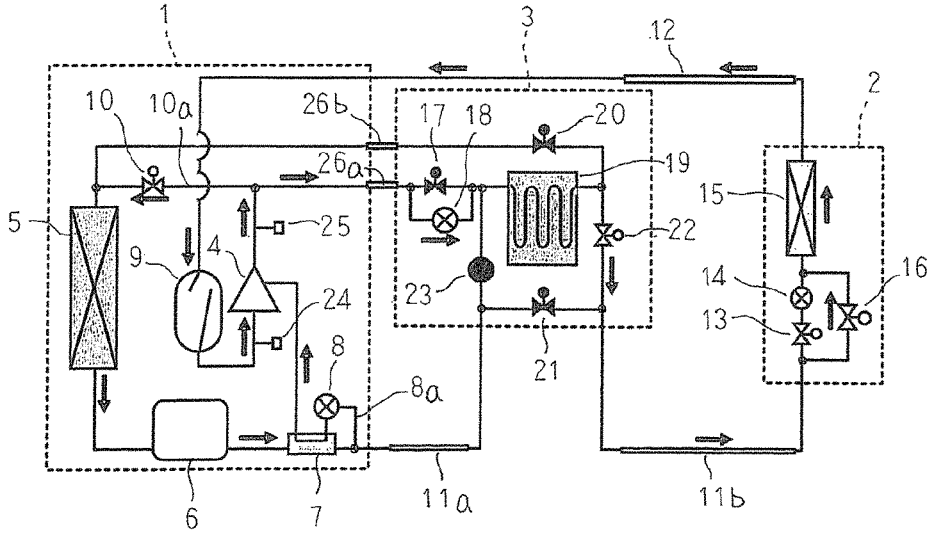
FIG. 4 is a refrigerant circuit diagram that shows flow of refrigerant during defrosting operation in the refrigerating apparatus according to Embodiment 1 of the present invention.
Figure 5:
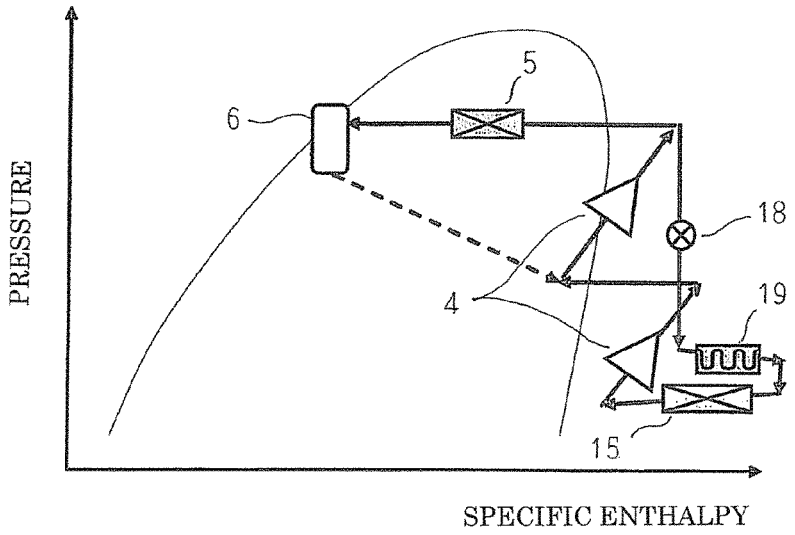
FIG. 5 is a phase diagram that represents refrigeration cycle operations during defrosting operation in the refrigerating apparatus according to Embodiment 1 of the present invention.

Next, refrigerating apparatus operations during defrosting operation will be explained with reference to FIGS. 4 and 5. FIG. 4 is a refrigerant circuit diagram that shows flow of refrigerant during defrosting operation in the refrigerating apparatus according to Embodiment 1 of the present invention, and FIG. 5 is a phase circuit diagram that represents refrigeration cycle operations during defrosting operation in the refrigerating apparatus according to Embodiment 1 of the present invention. Moreover, the arrows in FIG. 4 represent refrigerant flow.

In a defrosting operation mode, the electromagnetic valves 17, 20, and 21, the liquid electromagnetic valve 13, and the liquid injection valve 23 are closed, and the discharge bypass valve 10 and the electromagnetic valves 16, 18, and 22 are opened. A defrosting circuit is thereby formed in which refrigerant that is discharged from the compressor 4 is conveyed under pressure sequentially to the hot gas pressure regulating valve 18, the heat storing tank 19, the electromagnetic valve 22, the electromagnetic valve 16, and the evaporator 15, and is recycled to the compressor 4.

Thus, a majority of high-temperature refrigerant that is discharged from the compressor 4 is led to the defrosting unit 3 via the first discharge gas connection piping 26*a* as a hot gaseous refrigerant for defrosting, and a remaining portion is led to the air-cooled condenser 5 by means of the second bypass piping 10*a*.

The high-temperature refrigerant that has been led to the air-cooled condenser 5 exchanges heat with external air at the air-cooled condenser 5, becoming liquid refrigerant, and is injected into the intermediate pressure of the compressor 4 via the receiver 6, the economizer 7, and the economizer expansion valve 8. Abnormal rises in the temperature of the refrigerant that is discharged from the compressor 4 are avoided thereby.

The hot gaseous refrigerant that has been led to the defrosting unit 3 is decompressed by the hot gas pressure regulating valve 18, and is reduced in temperature to approximately 50 degrees Celsius, becoming a low-pressure gaseous refrigerant, and flows into the heat storing tank 19. At this hot gas pressure regulating valve 18, pressure is reduced such that the refrigerant pressure becomes lower than the zero-degrees-Celsius saturation pressure, for example, so as to become approximately 10 degrees Celsius lower than the saturation temperature. Because the heat storing medium inside the heat storing tank 19 is at a high temperature of 80 degrees Celsius, the hot gaseous refrigerant that has become a low-pressure gaseous refrigerant absorbs heat from the heat storing medium in the process of flowing through the heat storing tank 19, becoming hot again, and is led to the refrigerating unit 2 via the electromagnetic valve 22 and the second high-pressure piping 11*b*.

The hot gaseous refrigerant that has been led to the refrigerating unit 2 passes through the electromagnetic valve 16 and flows into the evaporator 15, the surface of which is covered by frost, without being decompressed significantly. Flowing through the evaporator 15, the hot gaseous refrigerant melts the frost that has adhered to the surface of the evaporator 15. Because the saturation temperature is adjusted to less than or equal to zero degrees Celsius, the hot gaseous refrigerant does not condense to a liquid at the melting temperature of the frost, i.e., zero degrees Celsius, but enters a superheated gaseous state at approximately zero degrees Celsius and flows out of the evaporator 15. The refrigerant in the superheated gaseous state that has flowed out of the evaporator 15 is led to the heating unit 1 via the low-pressure piping 12. The refrigerant that has been led to the heating unit 1 is sucked into the compressor 4 via the accumulator 9.

According to Embodiment 1, because evaporative waste heat that is generated during cooling operation is stored in the heat storing tank 19, and is used as a defrosting heat source during defrosting operation, the amount of heat that can be introduced to the frosted evaporator 15 is increased, enabling defrosting time to be shortened. Situations such as the temperature inside the cold storage room that is subject to cooling rising during defrosting operation in which cooling capacity is not fully operational can thereby be avoided.

Because the heat exchange path in the heat storing tank 19 for storing heat during cooling operation also functions as a heat exchange path that uses the stored heat during defrosting operation, equipment costs can be reduced. Dedicated piping for leading hot gaseous refrigerant to the evaporator 15 during defrosting operation is no longer required, enabling construction costs to be reduced. In the cooling operation mode and the defrosting operation mode, because it is not necessary to switch the flow channel on the low-pressure side, a large-diameter on-off valve for switching the flow channel on the low-pressure side is no longer required, enabling equipment costs to be reduced. Consequently, the refrigerating apparatus can be configured inexpensively.

In the defrosting operation mode, because the hot gas pressure regulating valve 18 is disposed upstream from the heat storing tank 19, high-pressure gaseous refrigerant that has been discharged from the compressor 4 is decompressed by the hot gas pressure regulating valve 18, and becomes low-temperature, low-pressure gaseous refrigerant. This low-temperature, low-pressure gaseous refrigerant flows into the heat storing tank 19, absorbs evaporation waste heat that is stored in the heat storing tank 19, becoming high-temperature, low-pressure gaseous refrigerant, and flows to the evaporator 15. Then, the high-temperature, low-pressure gaseous refrigerant enters a superheated gaseous state without condensing to a liquid during defrosting, and flows out of the evaporator 15. Because the refrigerant that flows out of the evaporator 15 is always a superheated gaseous refrigerant in this manner, liquid refrigerant is not sucked into the compressor 4. Thus, the occurrence of damage to the compressor that results from liquid refrigerant being sucked in can be prevented, enabling a highly reliable refrigerating apparatus to be achieved.

In addition, the accumulator 9 is connected to the intake side of the compressor 4. Thus, even if liquid refrigerant that was not vaporized properly inside the evaporator 15 does happen to remain in the refrigerant, the liquid refrigerant is accumulated in the accumulator 9, and is not sucked into the compressor 4. Thus, the occurrence of damage to the compressor that results from liquid refrigerant being sucked in can be reliably prevented, enabling an even more highly reliable refrigerating apparatus to be achieved.

Now, in Embodiment 1, in the defrosting operation mode, the refrigerant is always in a gaseous state, both when absorbing heat from the heat storing tank 19 and when defrosting the evaporator 15, and thermal input and output is only performed for the amount of sensible heat in the gaseous refrigerant, which depends on the temperature difference between the inlet and the outlet. If the amount of heat in the hot gaseous refrigerant is small, then the frost cannot be completely melted, and there is the risk that frost may remain locally. This unmelted frost is enlarged during cooling operation and is a cause of reduction in cooling performance.

Thus, in the defrosting operation mode, the liquid injection valve 23 is opened toward the end of defrosting. The high-pressure liquid refrigerant that has flowed out of the economizer 7 flows into the heat storing tank 19 by means of the first high-pressure piping 11*a* and the liquid injection valve 23, and vaporizes at once due to the high-temperature heat storing medium, and the low-pressure pressure rises to zero degrees Celsius or greater. The gaseous refrigerant in which the low-pressure pressure has risen to zero degrees Celsius or greater flows into the evaporator 15 by means of the electromagnetic valve 22, the second high-pressure piping 11*b*, and the electromagnetic valve 16, condenses to a liquid on portions in the evaporator 15 where frost at zero degrees Celsius remains, enabling locally unmelted frost to be selectively melted. Situations in which this unmelted frost is enlarged during cooling operation and reduces cooling performance can be preempted thereby.

Embodiment 2

Figure 6:
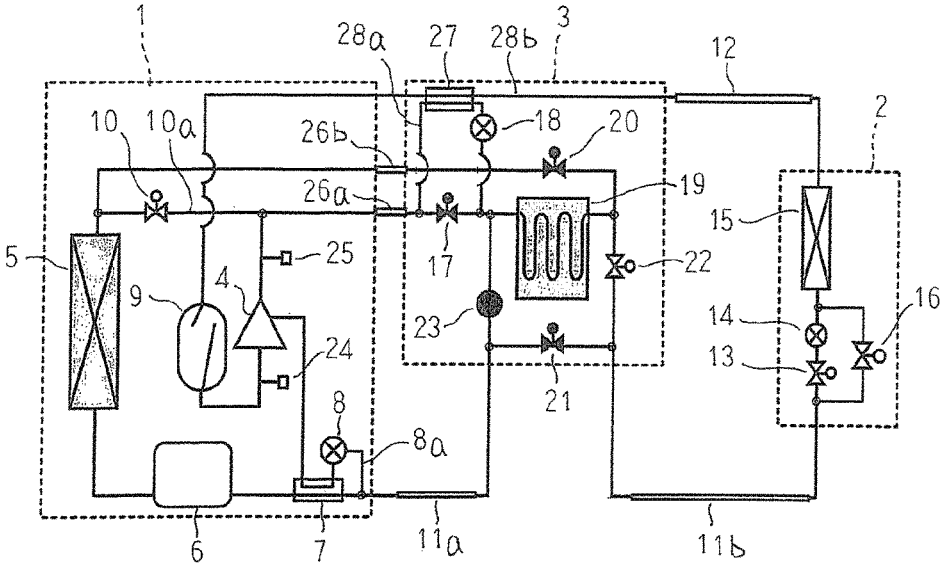
FIG. 6 is a refrigerant circuit diagram that shows flow of refrigerant during defrosting operation in a refrigerating apparatus according to Embodiment 2 of the present invention.
Figure 7:
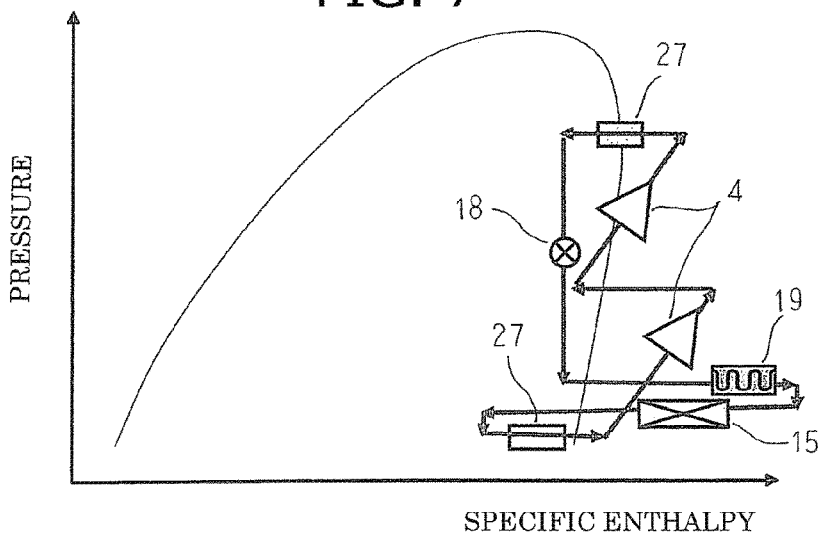
FIG. 7 is a phase diagram that represents refrigeration cycle operations during cooling operation in the refrigerating apparatus according to Embodiment 2 of the present invention.
Figure 8:
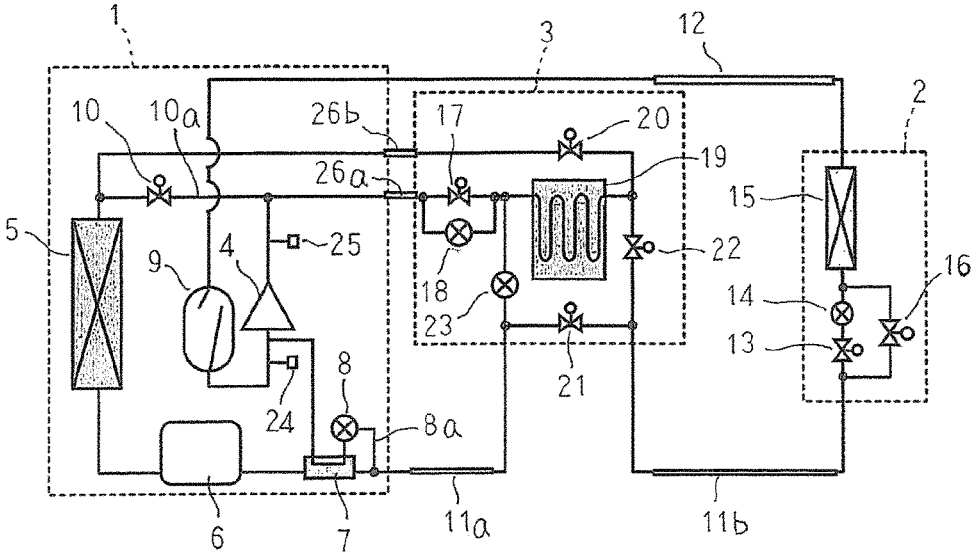
FIG. 8 is a refrigerant circuit configuration diagram of a modification of the refrigerating apparatus of FIG. 1.

FIG. 6 is a refrigerant circuit diagram that shows flow of refrigerant during defrosting operation in a refrigerating apparatus according to Embodiment 2 of the present invention, and FIG. 7 is a phase circuit diagram that represents refrigeration cycle operations during cooling operation in the refrigerating apparatus according to Embodiment 2 of the present invention.

In FIG. 6, a high-and-low-pressure heat exchanger 27 that functions as a second heat exchanging portion is configured so as to be able to exchange heat with: a refrigerant that flows through a pipeline 28*a* between a first discharge gas connection piping 26*a* and a hot gas pressure regulating valve 18; and a refrigerant that flows through a pipeline 28*b* between low-pressure piping 12 and an accumulator 9.

Moreover, the rest of the configuration is formed in a similar or identical manner to that of Embodiment 1 above.

In the defrosting operation mode of the refrigerating apparatus that is configured in this manner, the electromagnetic valves 17, 20, and 21, the liquid electromagnetic valve 13, and the liquid injection valve 23 are closed, and the discharge bypass valve 10 and the electromagnetic valves 16, 18, and 22 are opened in a similar or identical manner to Embodiment 1 above. Thus, a majority of high-temperature refrigerant that is discharged from the compressor 4 is led to the defrosting unit 3 via the first discharge gas connection piping 26*a* as a hot gaseous refrigerant for defrosting, and a remaining portion is led to the air-cooled condenser 5 by means of the discharge bypass valve 10.

The high-temperature refrigerant that has been led to the air-cooled condenser 5 exchanges heat with external air at the air-cooled condenser 5, becoming liquid refrigerant, and is injected into the intermediate pressure of the compressor 4 via the receiver 6, the economizer 7, and the first bypass piping 8*a*. Abnormal rises in the temperature of the refrigerant that is discharged from the compressor 4 are avoided thereby.

In the process of flowing through the pipeline 28*a*, the hot gaseous refrigerant that has been led to the defrosting unit 3 is made to exchange heat with the low-pressure gaseous refrigerant that flows through the pipeline 28*b* via the low-pressure piping 12 by the high-and-low-pressure heat exchanger 27, and is subsequently decompressed by the hot gas pressure regulating valve 18, reaching a low temperature that is close to a low-pressure saturation temperature. The hot gaseous refrigerant that has become a low-pressure refrigerant flows into the heat storing tank 19, and absorbs heat from the heat storing medium in the process of flowing through the heat storing tank 19, becoming hot again, and is led to the refrigerating unit 2 via the electromagnetic valve 22 and the second high-pressure piping 11*b*.

The hot gaseous refrigerant that has been led to the refrigerating unit 2 passes through the electromagnetic valve 16 and flows into the evaporator 15, the surface of which is covered by frost, without being decompressed significantly. Flowing through the evaporator 15, the hot gaseous refrigerant melts the frost that has adhered to the surface of the evaporator 15, becomes a low-temperature superheated gaseous refrigerant, and flows out of the evaporator 15. In the process of flowing through the pipeline 28*b* via the low-pressure piping 12, this low-temperature superheated gaseous refrigerant is made to exchange heat with the hot gaseous refrigerant that flows through the pipeline 28*a* by the high-and-low-pressure heat exchanger 27, and is led to the heating unit 1. The refrigerant that has been led to the heating unit 1 is sucked into the compressor 4 via the accumulator 9.

Moreover, because the cooling operation mode of this refrigerating apparatus operates in a similar manner to Embodiment 1 above, explanation thereof will be omitted.

Consequently, similar or identical effects to those in Embodiment 1 above are also exhibited in Embodiment 2.

According to Embodiment 2, the hot gaseous refrigerant is made to exchange heat with the low-temperature refrigerant that flows out of the evaporator 15 by the high-and-low-pressure heat exchanger 27, is cooled to a temperature that is close to the low-pressure saturation temperature, and is then made to flow to the heat storing tank 19. Thus, the amount of recovered heat when the hot gaseous refrigerant that has been cooled to a temperature that is close to the low-pressure saturation temperature absorbs the heat from the heat storing medium of the heat storing tank 19 and becomes hot again, that is, the usage rate of the evaporation waste heat, is increased. Defrosting time is thereby shortened.

Because the hot gaseous refrigerant can absorb heat from the refrigerant that has defrosted the evaporator 15, it is not necessary to make the low-pressure pressure less than or equal to zero degrees Celsius using the hot gas pressure regulating valve 18, enabling a portion of the refrigerant to be made to radiate until it condenses when defrosting the evaporator 15. Consequently, the amount of defrosting heat is increased by using the stored heat, enabling defrosting time to be further shortened.

Moreover, in each of the above embodiments, the first bypass piping 8*a* is connected to intermediate pressure of the compreassor 4, but the first bypass piping 8*a* may be connected to the intake side of the compressor 4.

The invention claimed is:

1. A refrigerating apparatus comprising:

a refrigerating circuit in which a refrigerant that is discharged from a compressor is conveyed under pressure sequentially to a first flow rate controlling apparatus, a heat storing tank, a condenser, a first decompressing apparatus, an evaporator, and an accumulator, and is recycled to said compressor;

a defrosting circuit in which said refrigerant that is discharged from said compressor is conveyed under pressure sequentially to said first flow rate controlling apparatus, said heat storing tank, said first decompressing apparatus, said evaporator, and said accumulator, and is recycled to said compressor;

a flow channel switching apparatus that connects an outlet side of said heat storing tank to an inlet side of said condenser or to an inlet side of said first decompressing apparatus to form said refrigerating circuit or said defrosting circuit;

a first bypass piping that branches off from between an outlet side of said condenser and said inlet side of said first decompressing apparatus and connects to a piping connecting an outlet side of said accumulator and an intake side of said compressor;

a second flow rate controlling apparatus that adjusts a flow rate of said refrigerant that flows through said first bypass piping;

a second bypass piping that connects a discharge side of said compressor to said inlet side of said condenser; and a discharge bypass valve that is disposed in said second bypass piping, and that opens and closes connection between said discharge side of said compressor and said inlet side of said condenser.

2. A refrigerating apparatus comprising:

a refrigerating circuit in which a refrigerant that is discharged from a compressor is conveyed under pressure sequentially to a first flow rate controlling apparatus, a heat storing tank, a condenser, a first decompressing apparatus, an evaporator, and an accumulator, and is recycled to said compressor;

a defrosting circuit in which said refrigerant that is discharged from said compressor is conveyed under pressure sequentially to said first flow rate controlling apparatus, said heat storing tank, said first decompressing apparatus, said evaporator, and said accumulator, and is recycled to said compressor;

a flow channel switching apparatus that connects an outlet side of said heat storing tank to an inlet side of said condenser or to an inlet side of said first decompressing apparatus to form said refrigerating circuit or said defrosting circuit;

a first bypass piping that branches off from between an outlet side of said condenser and said inlet side of said first decompressing apparatus and connects to a piping connecting an outlet side of said accumulator and an intake side of said compressor; and a second flow rate controlling apparatus that adjusts a flow rate of said refrigerant that flows through said first bypass piping, wherein said first decompressing apparatus comprises:

a first valve apparatus that decompresses said refrigerant that has flowed through said condenser and allows said refrigerant to flow to said evaporator when said outlet side of said heat storing tank is connected to said inlet side of said condenser by said flow channel switching apparatus; and a second valve apparatus that allows said refrigerant that has flowed through said heat storing tank to flow to said evaporator without decompression when said outlet side of said heat storing tank is connected to said inlet side of said first decompressing apparatus by said flow channel switching apparatus.

3. The refrigerating apparatus according to claim 2, further comprising a first heat exchanging portion that exchanges heat between said refrigerant that flows between said outlet side of said condenser and said inlet side of said first decompressing apparatus and said refrigerant that flows through said first bypass piping downstream from said second flow rate controlling apparatus.

4. A refrigerating apparatus comprising:

a refrigerating circuit in which a refrigerant that is discharged from a compressor is conveyed under pressure sequentially to a first flow rate controlling apparatus, a heat storing tank, a condenser, a first decompressing apparatus, and an evaporator, and is recycled to said compressor;

a defrosting circuit in which said refrigerant that is discharged from said compressor is conveyed under pressure sequentially to said first flow rate controlling apparatus, said heat storing tank, said first decompressing apparatus, and said evaporator, and is recycled to said compressor;

a flow channel switching apparatus that connects an outlet side of said heat storing tank to an inlet side of said condenser or to an inlet side of said first decompressing apparatus to form said refrigerating circuit or said defrosting circuit;

wherein said first decompressing apparatus comprises:

a first valve apparatus that decompresses said refrigerant that has flowed through said condenser and allows said refrigerant to flow to said evaporator when said outlet side of said heat storing tank is connected to said inlet side of said condenser by said flow channel switching apparatus; and a second valve apparatus that allows said refrigerant that has flowed through said heat storing tank to flow to said evaporator without decompression when said outlet side of said heat storing tank is connected to said inlet side of said first decompressing apparatus by said flow channel switching apparatus.

5. The refrigerating apparatus according to claim 4, further comprising:

a second bypass piping that connects a discharge side of said compressor to said inlet side of said condenser; and a discharge bypass valve that is disposed in said second bypass piping, and that opens and closes connection between said discharge side of said compressor and said inlet side of said condenser.

6. The refrigerating apparatus according to claim 4, wherein said first flow rate controlling apparatus comprises a second heat exchanging portion that exchanges heat between said refrigerant that is discharged from said compressor and said refrigerant that flows out of said evaporator, when said outlet side of said heat storing tank is connected to said inlet side of said first decompressing apparatus by said flow channel switching apparatus.

7. The refrigerating apparatus according to claim 4, further comprising a liquid injection valve that allows said refrigerant that has flowed out of said condenser to flow to said heat storing tank.

* * * * *